US005690483A

United States Patent [19]

Oda et al.

[11] Patent Number: 5,690,483

[45] Date of Patent: Nov. 25, 1997

[54] GASEOUS FUEL BURNER

[75] Inventors: Kenneth J. Oda, Elk Grove Village; Donald M. Krueger, Westchester; Stefan J. Szewczyk, Lansing; George R. Kell, Geneva; Norman K. Peck, Bloomingdale, all of Ill.

[73] Assignee: Eaton Coporation, Cleveland, Ohio

[21] Appl. No.: 682,464

[22] Filed: Jul. 17, 1996

[51] Int. Cl.[6] ..... F23Q 3/00

[52] U.S. Cl. ..... 431/266; 431/354; 126/39 R; 126/39 E

[58] Field of Search ..... 126/39 R, 39 E, 126/39 D, 39 H, 39 K; 431/354, 266, 328, 326

[56] References Cited

U.S. PATENT DOCUMENTS

| | | | |
|---|---|---|---|
| 1,506,168 | 8/1924 | Erikstrup | 431/354 X |
| 3,289,731 | 12/1966 | Geber | 431/354 X |
| 3,825,404 | 7/1974 | DeGouville | 431/354 |
| 4,217,880 | 8/1980 | Turner, Jr. | 126/531 |
| 4,264,298 | 4/1981 | Simeoni | 126/391 X |
| 4,565,523 | 1/1986 | Berkelder | 431/354 |
| 5,149,262 | 9/1992 | Riehl | 126/39 K |
| 5,492,469 | 2/1996 | Oda et al. | 431/266 |
| 5,545,036 | 8/1996 | Kwiatek | 431/266 |
| 5,620,317 | 4/1997 | Sigler | 431/266 |

*Primary Examiner*—Larry Jones
*Attorney, Agent, or Firm*—Roger A. Johnston

[57] ABSTRACT

A gaseous fuel burner with a base formed of cast aluminum and a wafer cooperating with the base for forming an annular of flame generating ports. A cap is received over the wafer and forms a dead air space for reducing the temperature rise of the cap. The wafer and base are formed of aluminum or brass and the cap is either formed of cast iron or cast aluminum with a porcelainized steel disc insert on the upper surface.

14 Claims, 4 Drawing Sheets

GASEOUS FUEL BURNER

BACKGROUND OF THE INVENTION

The present invention relates to burners for gaseous fuel/air mixtures such as are employed for cooking appliances and particularly cook tops and range tops utilized for household and commercial cooking. Gaseous fuel burners for top cooking are typically arranged in an annular configuration with a plurality of flame generating ports disposed to provide a virtual ring of flame for heating a receptacle such as in a pot, a pan or a boiler containing liquid or comestibles. Currently, mass produced burners for cooktop usage have the burner assembly arranged to be received over a fuel supply tube in such a manner that the interconnection of the tube to the burner forms an aspirator for drawing in primary combustion air which is mixed in a plenum chamber within the burner and discharged through the flame generating ports. Such annular fuel burner arrangements for top burners of cooking appliances are commonly ignited by a spark discharge electrode provided adjacent the flame generating ports; and, electrical circuitry is employed for user operated initiation of the spark discharge upon commencement of burner usage.

Heretofore, annular cooktop burners have either been stamped or cast of iron based material such as stainless steel or cast iron to form the burner ring in order to utilize materials able to withstand the temperatures of the flame. However, the use of iron based materials for the burner base and portion forming the flame generating ports has proven to be costly in terms of material costs, tooling and manufacturing operations for high-volume mass production of domestic cooktop appliances. It has thus been desired to find a way of making an annular or ring shaped cooktop burner from light material and with reduced cost manufacturing techniques.

It has been attempted to form a gaseous fuel burner from light metal such as aluminum to enable the burner to be fabricated by low cost techniques such as casting; however, the flame temperature has resulted in melting of the burner cap where the cap has been formed of as cast aluminum. Although it has been found that an aluminum burner cap will withstand the flame temperatures if the cap is alloyed with iron or forged, such techniques of construction have been found to be prohibitively costly for mass production of cooktop burners for household appliances.

SUMMARY OF THE INVENTION

The present invention provides an annular gaseous fuel burner suitable for cooktop applications which has a cast aluminum base and flame generating ring formed of either cast aluminum or brass with a flame deflecting cover or cap formed of either cast iron or aluminum having a ceramic coated steel insert. The burner has an air plenum formed between the flame genera,ting wafer and the cover to provide thermal isolation of the cover to prevent melting of the as cast aluminum material.

DETAILED DESCRIPTION

Figure 1:
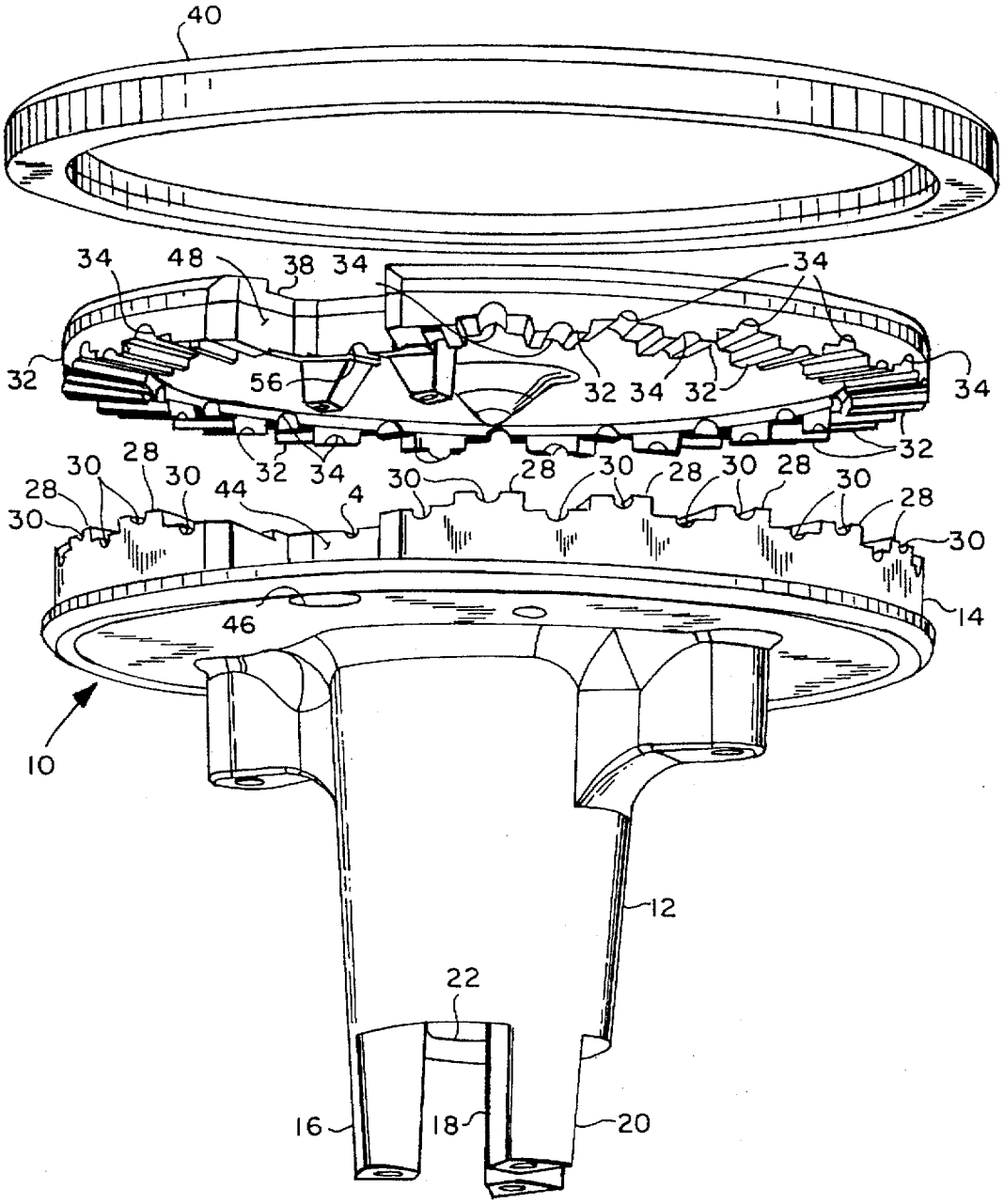
FIG. 1 is an exploded view of a cast aluminum burner having a cast iron cap.
Figure 2:
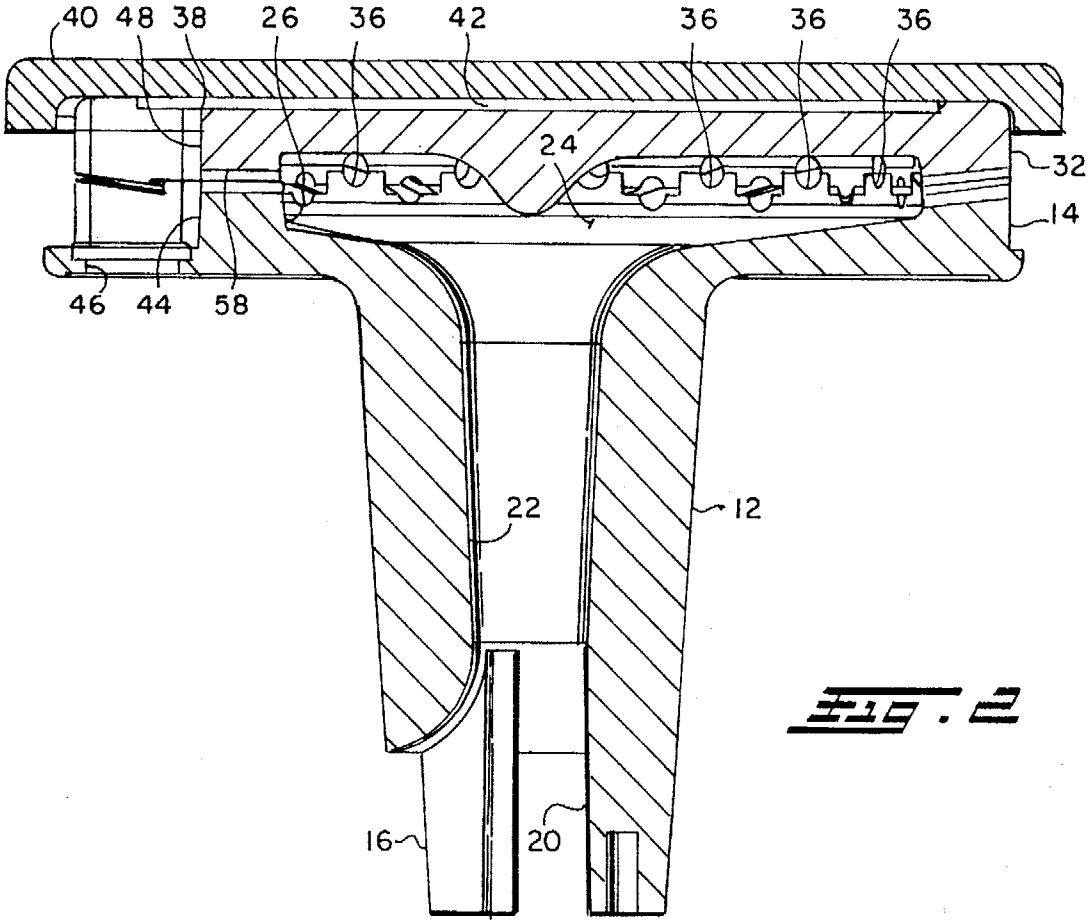
FIG. 2 is a cross-sectional view of the assembled burner of FIG. 1.

Referring to FIGS. 1 and 2, one embodiment burner assembly practicing the present invention is illustrated generally at 10 and includes a base having a generally cylindrical attachment portion 12 and an enlarged diameter flame generating port forming portion 14 with a plurality of integrally formed attachment stanchions 16, 18.20, which stanchions define therebetween air inlet passages to the central fuel/air inlet passage 22 The inlet passage 22 communicates with a plenum cavity. 24 which is bounded by an annular wall 26 formed on an enlarged portion 14 of the base with the upper axial face of the wall 26 having formed thereon a plurality of castellations 28 each of which has formed thereon a groove 30.

A wafer 32 having a generally circular or disc-like configuration has a corresponding plurality of castellations 32 formed on the undersurface thereof about the periphery with a plurality of grooves 34 formed therein. Wafer 32 is disposed to cover cavity 24 with the castellations thereof interdigitated with the grooves castellations 30 of the portion 14 of the base to define a plurality of flame generating ports denoted by reference numeral 36 in FIG. 2. The upper face of wafer 32 has a recess or cavity 38 formed therein which is covered by a cap 40 having the rim formed to extend outwardly from the outer periphery 32 of the wafer. The recess 38 thus forms with the cap a closed chamber in the form of a dead air space 42 formed between the recess 38 in the upper surface of the wafer and the undersurface of the cap 40.

The enlarged ring portion 14 of the base 12 has a pocket 44 formed in the periphery thereof between two of the adjacent ports 30 and a hole or aperture 46 is formed through the base for receiving therein a suitable spark ignitor. A corresponding pocket 48 is formed in the wafer 32.

Figure 5:
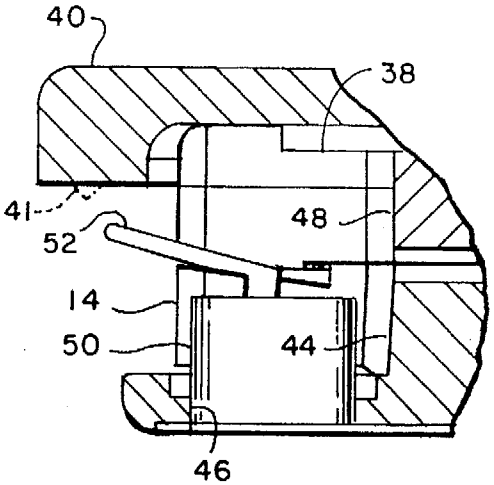
FIG. 5 is an enlarged detail of a portion of FIG. 2.

Referring to FIG. 5, the aperture 46 in the base has received therein a holder 50 formed of insulating material which has extending therefrom an electrode 52 for providing a spark discharge to the undersurface of the rim of cap 40.

Referring to FIG. 1, the ignitor pocket 44, 48 has grooves 54, 56 formed respectively therein in the back wall thereof which form a flame generating port 58 (see FIG. 2) in the assembled burner through which fuel/air mixture passes to be ignited by the spark discharged from electrode 52.

The portion of the recess 38 in the upper surface of the wafer 32 in the region of the pocket 48 provides an area into which the flame generated at the ignitor port 58 can enter; and, this area of the recess serves as a flame stabilization region.

The undersurface of cap 40 is preferably roughened in the region of pocket 44 to direct arcing from the igniter electrode. Alternatively a slight projection extending downward as shown in dashed outline in FIG. 5 by reference numeral 41 may be provided on the cap.

Figure 3:
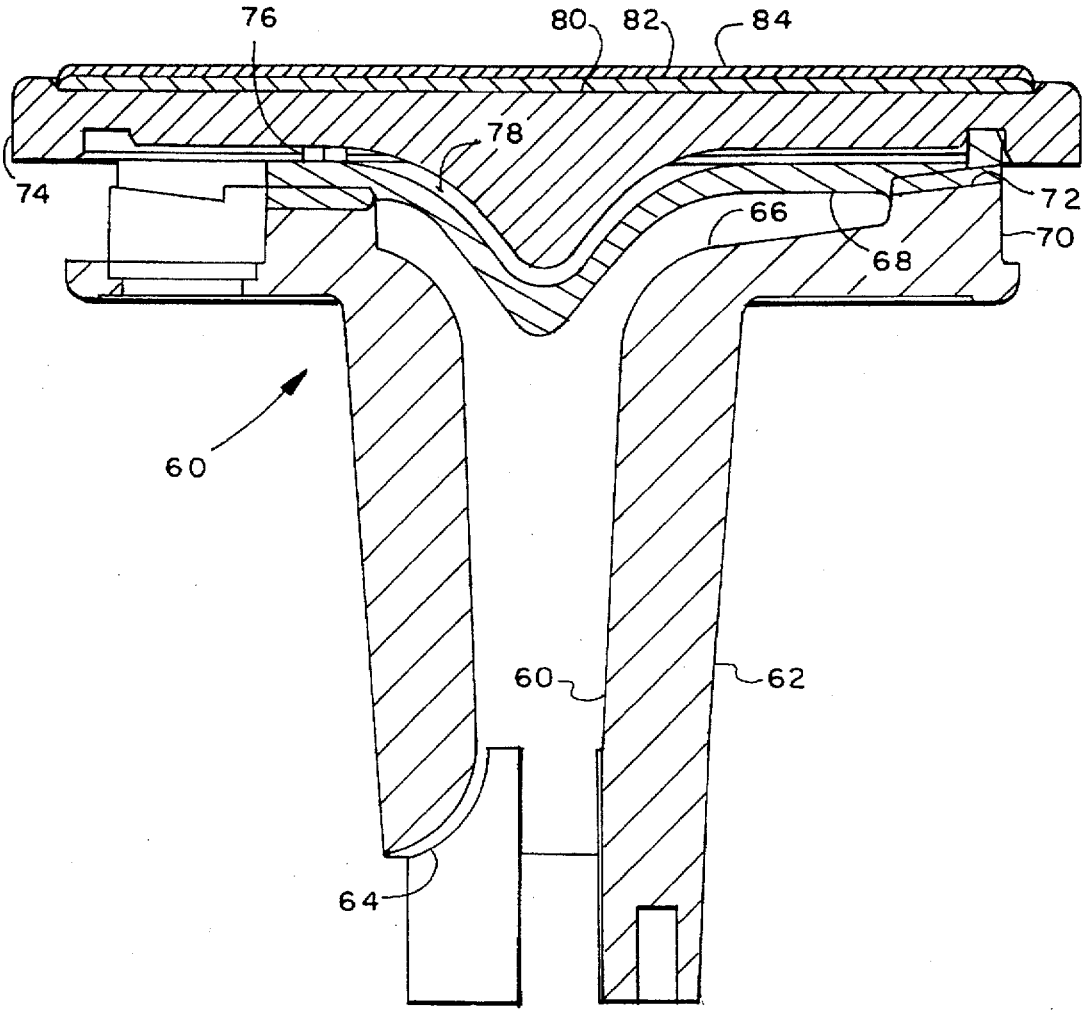
FIG. 3 is a cross-sectional view of a burner having a cast aluminum base and cap with a brass wafer.
Figure 4:
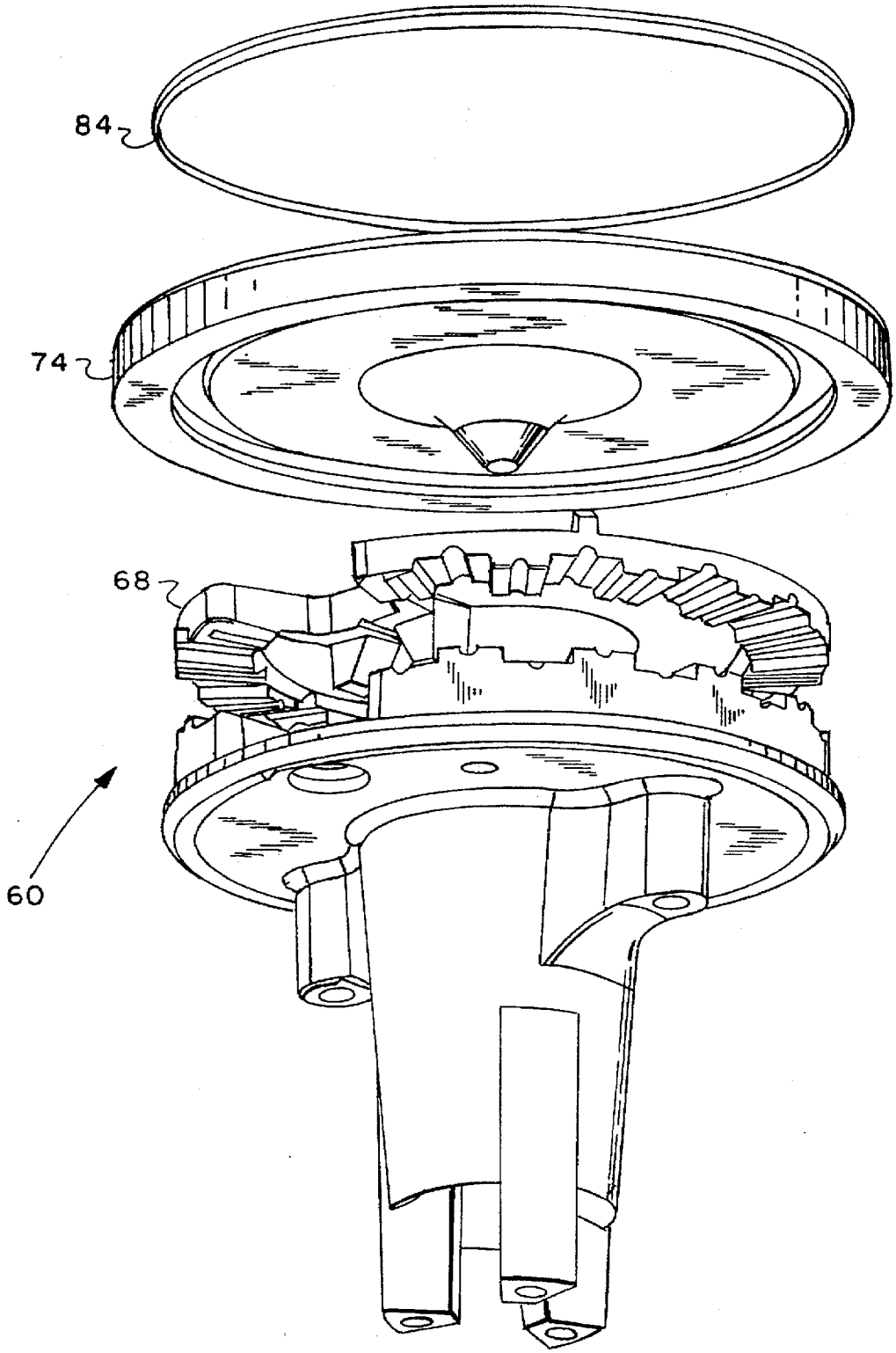
FIG. 4 is an exploded view of the burner of FIG. 3.

Referring to FIGS. 3 and 4, another embodiment of the invention indicated generally at 60 and has a body having a reduced diameter portion 62 having an inlet passage 64 formed therein with aspirating slots such as the one identified by reference numeral 64 for providing a flow of gaseous fuel and air in passage 60 upward to an enlarged plenum cavity 66. The upper end of the burner base has an enlarged diameter portion 70 with a plenum cavity 66 formed therein which is closed by a generally circular wafer 68 received thereover. In the present practice of the invention of the embodiment of FIG. 3, the wafer 68 is formed of cast brass material and cooperates with the rim of enlarged diameter portion 70 of the base to form a plurality of circumferentially spaced castellated surfaces which are interdigitated and form a plurality of flame generating ports 72 in a manner similar to the embodiment of FIG. 2.

An aluminum cap 74 is received over the wafer 68 and registered thereagainst on a plurality of circumferentially spaced stanchions disposed on the upper surface of the wafer 68, one of which is illustrated in FIG. 3 and denoted by reference numeral 76. The undersurface of the cap is recessed to define a dead air space 78 between the upper surface of the wafer 68 and the under surface of cap 74

Referring to FIGS. 3 and 4, the upper surface of cap 74 has a recess 80 formed therein into which is received a disc 82 which is formed substantially of iron material and which has a refractory or ceramic coating 84 on the exposed surface thereof for protecting the upper surface of the aluminum cap 74. In the presently preferred practice, cap 74 has the upper surface thereof porcelainized.

The present invention thus provides a unique and novel ring burner assembly formed of light metal and having the cap thereof provided with a temperature reducing dead air space on the undersurface thereof for preventing melting of the light metal from the heat of the burner flame or alternatively, the cap is formed of iron material.

Although the present invention has hereinabove been described with respect to the illustrated embodiments, it will be understood that the invention is capable of modification and variation and is limited only by the scope of the following claims.

We claim:

1. A burner assembly for gaseous fuel comprising:

(a) a body formed of a metallic material having a melting point less than the ignition temperature of said fuel and having an annular configuration with an inlet adapted for connection to a source of gaseous fuel and air and communicating with a cavity defined by a portion distal said inlet;

(b) a wafer disposed over said cavity and closing same to form a fuel-air plenum chamber and cooperating with said base to define a plurality of peripheral flame generating ports each communicating with said fuel-air plenum chamber; and, (c) a cap formed substantially of metallic material and disposed over said wafer, said cap and wafer defining therebetween an air plenum for limiting the temperature rise of said cap.

2. The burner assembly defined in claim 1 wherein said wafer is formed of material selected from the group consisting essentially of aluminum and copper alloy and said cap is formed of substantially iron material.

3. The burner assembly defined in claim 1, wherein said cap extends radially outwardly of said wafer.

4. The burner assembly defined in claim 1, wherein said wafer is formed substantially of aluminum and said cap is formed substantially of iron material.

5. The burner assembly defined in claim 1, wherein said base, water and cap are formed substantially of aluminum material.

6. The burner assembly defined in claim 1, wherein said cap is formed of aluminum and includes a steel disc having a refractory coating.

7. The burner assembly defined in claim 1, wherein said cap includes a member having a porcelain coating.

8. The burner assembly defined in claim 1, wherein said base is formed substantially of aluminum material.

9. The burner assembly defined in claim 1, wherein said base is formed of substantially aluminum, said wafer is formed substantially of copper alloy material and said cap includes a relatively thin disc formed of steel and said coating comprises porcelain material.

10. The burner assembly defined in claim 1, wherein said cap defines an ignition pocket intermediate two of said plurality of flame generating ports and said wafer and said cap define a recess therebetween said recess communicating with said pocket for enhancing fuel-air ignition in said pocket.

11. A burner assembly for gaseous fuel comprising:

(a) a body formed of metallic material having a melting point less than the ignition temperature of said fuel and having an annular configuration with an inlet adapted for connections to a source of gaseous fuel and air and communicating with a cavity defined by a portion distal said inlet;

(b) a wafer disposed over said cavity and closing same to form a fuel air-plenum chamber and cooperating with said base to define a plurality of peripheral flame generating ports each communicating with said fuel-air plenum chamber and an ignition pocket, said pocket adapted for having a spark ignitor disposed therein;

(c) a cap formed of metallic material and disposed over said wafer and closing said pocket, said cap having the surface thereof closing said pocket being a rough surface for directing arcing of said spark ignitor.

12. The burner defined in claim 11, wherein said cap and water define therebetween an air plenum for limiting the temperature rise of cap.

13. The burner defined in claim 11, wherein said cap is formed of material selected from the group consisting essentially of aluminum, copper alloy and iron.

14. The burner defined in claim 11, wherein said rough surface of said cap includes a projection extending therefrom into said pocket.

* * * * *